US007607246B2

(12) United States Patent
Valiyambath Krishnan et al.

(10) Patent No.: US 7,607,246 B2
(45) Date of Patent: Oct. 27, 2009

(54) METHOD FOR GENERATING A BURST OF STEAM FROM A STEAM IRON

(75) Inventors: Mohankumar Valiyambath Krishnan, Singapore (SG); Zhenhua Yu, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 11/997,095

(22) PCT Filed: Jul. 18, 2006

(86) PCT No.: PCT/IB2006/052455

§ 371 (c)(1), (2), (4) Date: Jan. 28, 2008

(87) PCT Pub. No.: WO2007/013002

PCT Pub. Date: Feb. 1, 2007

(65) Prior Publication Data

US 2008/0229628 A1 Sep. 25, 2008

(30) Foreign Application Priority Data

Jul. 29, 2005 (EP) ..... 05107036

(51) Int. Cl.
*D06F 75/18* (2006.01)
*D06F 75/26* (2006.01)

(52) U.S. Cl. ..... 38/77.83

(58) Field of Classification Search ..... 38/77.1, 38/773, 77.6, 77.81, 77.83, 77.9, 85, 77.8; 219/245, 247, 254; 68/222
See application file for complete search history.

(56) References Cited

U.S. PATENT DOCUMENTS

| | | | | |
|---|---|---|---|---|
| 2,316,907 | A | 4/1943 | Wallace | |
| 2,568,104 | A * | 9/1951 | Young | 38/77.6 |
| 2,597,763 | A * | 5/1952 | Sussman | 38/77.6 |
| 3,436,852 | A * | 4/1969 | Stansbury | 38/77.6 |
| 5,189,726 | A * | 2/1993 | Pan | 329/401 |
| 5,341,585 | A * | 8/1994 | Stephan et al. | 38/77.5 |
| 5,832,639 | A * | 11/1998 | Muncan | 38/77.6 |
| 6,212,332 | B1 | 4/2001 | Sham | |
| 6,622,404 | B2 * | 9/2003 | Valiyambath | 38/96 |

(Continued)

FOREIGN PATENT DOCUMENTS

| | | |
|---|---|---|
| FR | 2512473 | 3/1983 |

(Continued)

*Primary Examiner*—Ismael Izaguirre

(57) ABSTRACT

A steam ironing device (1) comprises a steam generator (20) for heating water to steam, a steam outlet (25) for letting out a burst of steam (27) from the steam generator (20), a device (30) for supplying water to the steam generator (20), a hose (40) connecting the water supplying device (30) to the steam generator (20), and a controller (50) which is adapted to operating the water supplying device (30) during a period of time in a situation in which there is hardly any need or no need at all of a supply of steam in an ironing process, while keeping the steam outlet (25) closed. In this way, a reserve amount of steam is generated, which is stored in an internal space (21) of the steam generator (20), and, as the occasion arises, inside at least a portion of the hose (40). When a burst of steam (27) is required, the reserve amount of steam is released through the steam outlet (25).

15 Claims, 2 Drawing Sheets

Figure 1:
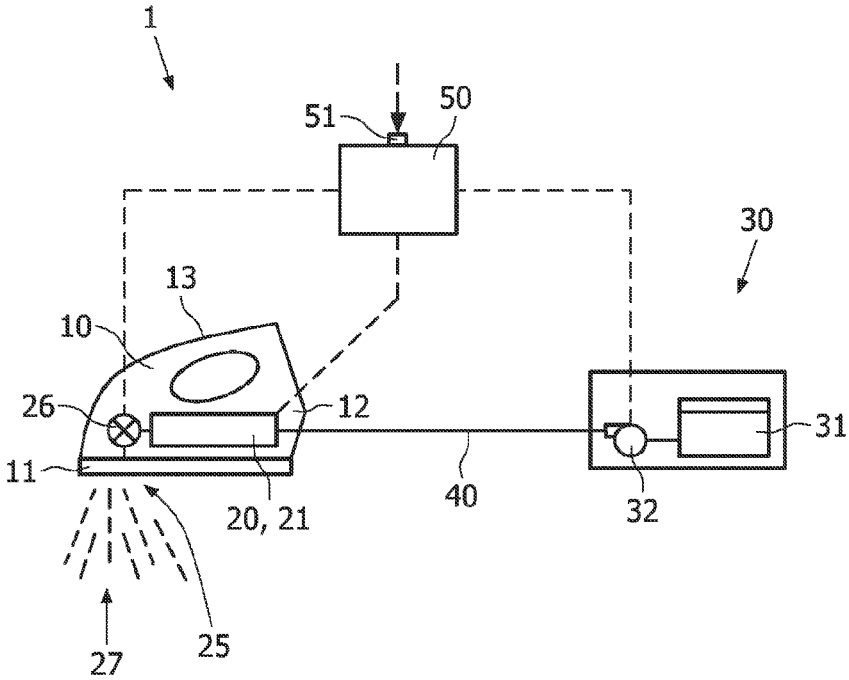

U.S. PATENT DOCUMENTS 6,711,840 B1 * 3/2004 Rosenzweig ..... 38/69
7,191,554 B2 * 3/2007 Almanzar et al. ..... 38/77.5

FOREIGN PATENT DOCUMENTS

WO 0175360 10/2001
WO 2004085732 10/2004
WO 2005054564 6/2005
WO 2005059232 6/2005

* cited by examiner

METHOD FOR GENERATING A BURST OF STEAM FROM A STEAM IRON

The present invention relates to a method for generating a burst of steam from a steam outlet of a steaming device having a steam generator for heating water to steam.

A well-known example of such a steaming device is a steam iron, which is applicable in a process of ironing items such as garments, during which wrinkles are removed from the items under the influence of steam that is supplied to the items by the steam iron. At some points during a steam ironing process, there may be a need for a burst of steam from the steam iron, for example for the purpose of removing severe wrinkles from an item that is subjected to the steam ironing process. It is not easy to meet such a need in an appropriate manner, given the fact that the dimensions of the steam generator are limited, so that the steam iron is prevented from being too bulky and too heavy. Also, by applying a steam generator having limited dimensions, it is achieved that the time that is needed for heating up the steam generator is limited. Consequently, the steam generator has a low energy storage capacity.

At first sight, it may seem that a solution is to be found in increasing the capacity of a device for supplying water to the steam generator, which usually comprises a pump. However, such a solution would involve an undesirable increase of the dimensions and the weight of the pump. Moreover, the level of noise generated by the pump during operation would be increased. Also, the pump would be too expensive for application in a common steam iron. Therefore, there is a need for another solution.

According to the state of the art, a solution is found in equipping the steam iron with a pressure reservoir in which water is kept in a pressurized condition. For example, U.S. Pat. No. 5,341,585 discloses a steam iron comprising a pressure-loaded water reservoir. When normal steam is produced during operation of the steam iron, the pressure reservoir is not in operation, and a water supply to the steam generator is effected via the pump of the steam iron. In order to produce additional steam, the contents of the pressure reservoir are fed to an auxiliary steam generator, thus producing a burst of steam.

It is an objective of the present invention to provide another solution to the problem of generating a burst of steam from a steaming device such as a steam ironing device, wherein it is possible to obtain a more powerful burst of steam. The objective is achieved by means of the method according to the present invention, which comprises the following subsequent steps:

supplying water to the steam generator during a period of time while keeping the steam outlet closed, wherein steam is generated by the steam generator;

storing at least a portion of the steam inside the steaming device; and opening the steam outlet, whereupon the steam is released through the steam outlet as a burst of steam.

According to the present invention, the steam generator is also used for the purpose of generating steam while the steam outlet is kept closed, during a period of time. At least a portion of the steam that is generated on the basis of water supplied to the steam generator during that period of time is stored inside the steaming device. In particular, the steam may be stored inside an internal space of the steam generator, and probably also in an additional space, for example space offered by a connection member extending between the steam generator and a device for supplying water to the steam generator and/or space offered by a reservoir which is typically provided for the purpose of storing steam. As the dimensions of the space that is present inside the steaming device are limited, and a temperature prevailing inside the steam generator is at a relatively high level, for example a level of approximately 160° C., pressure is built up inside the steaming device.

When the steam outlet is opened, the steam is released from the steaming device. In the process, an amount of steam that is stored in the space of the steam generator is immediately released from the steam outlet. In case an amount of steam is also stored in an additional space, this amount of steam is immediately supplied to the steam generator and released from the steam outlet as well. The immediate release of steam from the steam outlet constitutes a burst of steam.

An important difference between the method according to the present invention and the method according to the state of the art is that when the method according to the present invention is applied, a burst of steam is realized by feeding steam to the steam generator, whereas when the method according to the state of the art is applied, a burst of steam is realized by feeding water to the steam generator. Hence, when the method according to the present invention is applied, a process of effecting a burst of steam is more effective, as there is no need of evaporating water before letting out the steam. In experiments, it has appeared that by adapting a common steam iron to performing the method according to the present invention, a steam rate of 100 g/min may be realized, at a pressure of 4 bar, while the burst of steam may run as long as 2 metres.

Advantageously, the method according to the invention also involves feeding water in a pressurized condition to the steam generator when the steam outlet is opened. In such a case, the burst of steam is not only obtained on the basis of the steam that has been generated during a preceding period of time in which water has been supplied to the steam generator, but also on the basis of an amount of pressurized water that is fed to the steam generator, as the water is immediately evaporated inside the steam generator, whereupon the steam thus generated is released through the steam outlet. Given the fact that the method according to the state of the art only involves feeding water in a pressurized water to the steam generator for the purpose of realizing a burst of steam, it is all the more clear that it is possible to achieve a more powerful burst of steam when the method according to the present invention is applied, as the latter method also involves building up a reserve amount of steam and letting out this steam from the steam outlet.

During the period of time in which the steam outlet is closed and water is supplied to the steam generator, a total amount of generated steam increases, and a pressure prevailing inside the space in which the steam is stored increases as well. In order to prevent the pressure from reaching a dangerously high level, the length of time during which water is supplied to the steam generator while the steam outlet is kept closed has a predetermined value. According to a more sophisticated option, the length of time during which water is supplied to the steam generator while the steam outlet is kept closed is related to an actual value of a pressure prevailing inside the steaming device, wherein the supply of water is stopped as soon as this pressure has reached a predetermined value. In such a case, the steaming device may be equipped with means for measuring the actual value of the pressure.

In a practical way of carrying out the method according to the present invention, a device comprising a pump is used for the purpose of supplying water to the steam generator, wherein the pump is operated during a period of time while the steam outlet is kept closed.

According to a feasible option, a portion of the steam that is generated during the period of time in which the steam outlet is kept closed is released through outlet holes of the steaming device, which serve for letting out normal amounts of steam. In this way, when the method according to the present invention is applied, it is possible to alternate periods of normal operation of the steaming device, during which normal amounts of steam are released, with relatively short periods during which a burst of steam is released.

The present invention also relates to a steaming device such as a steam iron, comprising:

a steam generator for heating water to steam;

a steam outlet for letting out a burst of steam from the steam generator;

a device for supplying water to the steam generator; and controlling means which are adapted to operating the water supplying device during a period of time while keeping the steam outlet closed, and to opening the steam outlet upon receipt of input representing a user's need of a burst of steam from the steam outlet.

The controlling means of the above-described steaming device are adapted to carrying out the method according to the present invention for generating a burst of steam from the steam outlet of the steaming device. In particular, the controlling means are adapted to allowing for a supply of water to the steam generator when the steam outlet is closed, during a period of time, wherein a reserve amount of steam is generated inside the steaming device, which is released as a burst of steam when the steam outlet is opened. For the purpose of receiving input of a user, any suitable means may be provided. For example, the steaming device may comprise a button, wherein putting the button to a depressed condition generates a signal which represents a need of producing a burst of steam, and which is transmitted to the controlling means.

In a practical embodiment of the steam iron according to the present invention, the water supplying device is connected to the steam generator through a connection member such as a hose. The steam that is generated by the steam generator during the period of time in which the steam outlet is kept closed is stored in the space of the steam generator, and may also be stored in at least a portion of the connection member. Preferably, the steaming device according to the present invention comprises a steam reservoir for containing the reserve amount of steam, which may be arranged on the connection member.

In a preferred embodiment, the steaming device according to the present invention further comprises a pressurized water tank which is adapted to storing water and keeping water in a pressurized condition, and which is connected to the connection member, through a controllable water outlet member such as a valve. For sake of completeness, it is noted that the term "valve" is used to indicate a device of which a condition can be adjusted. In an opened condition, the valve is capable of letting pass a flow of a fluid or a mixture of fluids. In a closed condition, the valve blocks such a flow. In particular, the water outlet member arranged between the pressurized water tank and the connection member may be an electrovalve, and the pressurized water tank may be a spring-loaded water tank. Advantageously, in this embodiment, the controlling means are adapted to putting the water outlet member to an opened condition upon receipt of input representing a user's need of a burst of steam from the steam outlet, so that the burst of steam is not only realized on the basis of a release of steam that has previously been stored inside the steaming device, but also on the basis of steam that is obtained by evaporating the water supplied by the pressurized water tank.

According to a practical possibility, the water supplying device of the steaming device comprises a pump, and the controlling means are adapted to operating the pump during a period of time while keeping the steam outlet closed for the purpose of generating a reserve amount of steam that may be released as a burst of steam when the steam outlet is opened.

Figure 2:
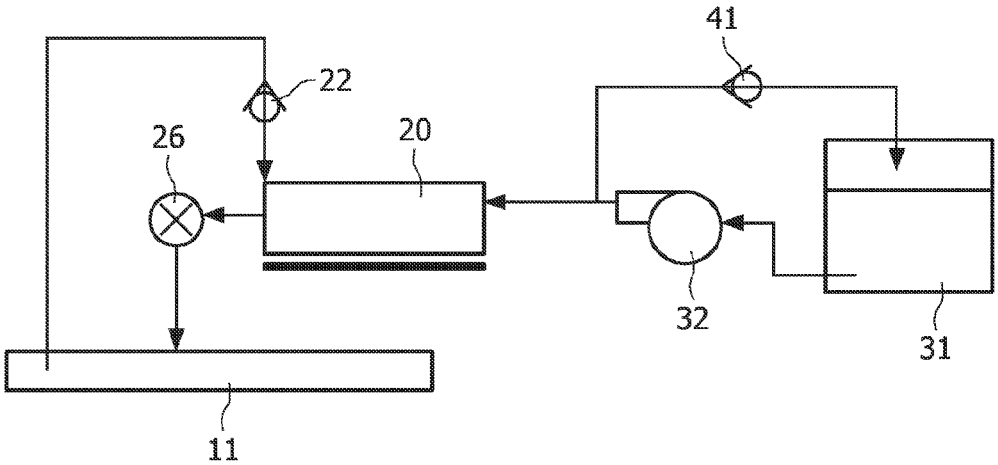
Figure 3:
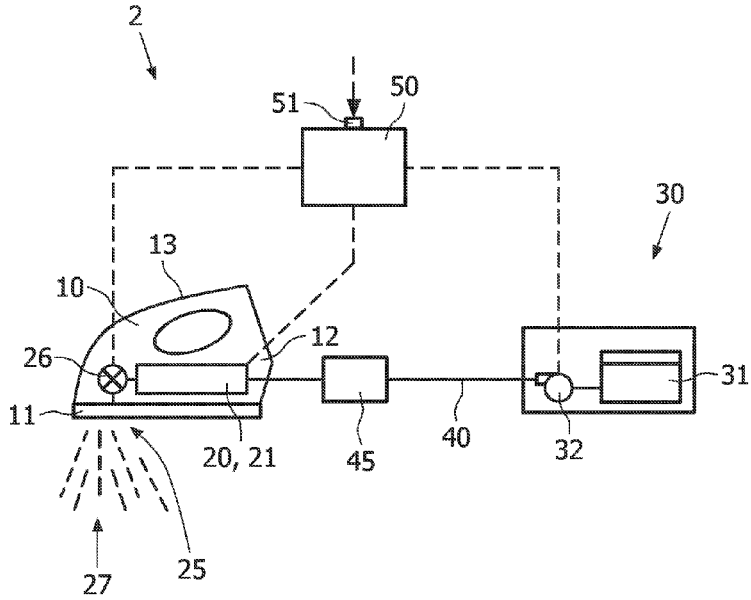
Figure 4:
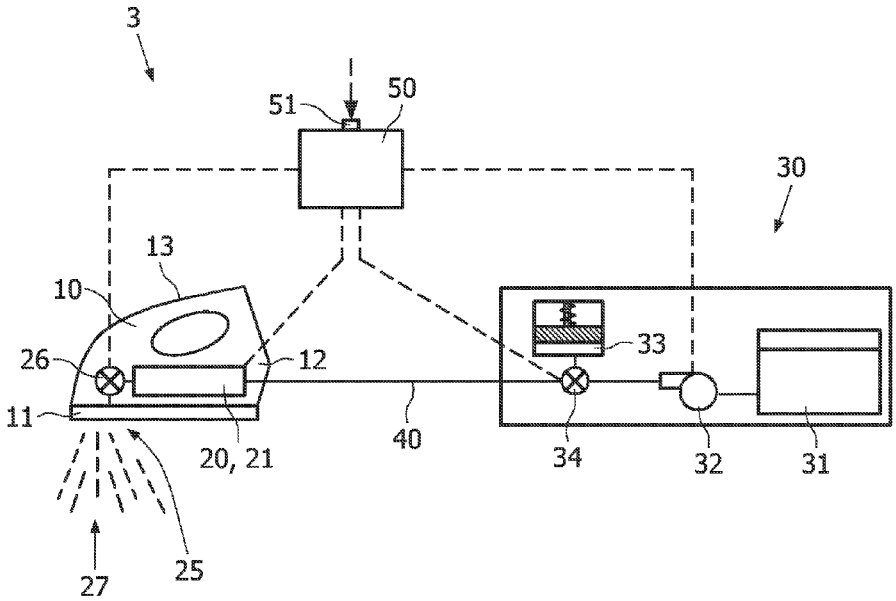

The present invention will now be explained in greater detail with reference to the figures, in which similar parts are indicated by the same reference signs, and in which:

FIG. 1 diagrammatically shows a steam ironing device according to a first preferred embodiment of the present invention;

FIG. 2 diagrammatically shows a number of components of the steam ironing device according to the first preferred embodiment of the present invention, and illustrates how flows of water, air and steam may take place in this steam ironing device;

FIG. 3 diagrammatically shows a steam ironing device according to a second preferred embodiment of the present invention; and FIG. 4 diagrammatically shows a steam ironing device according to a third preferred embodiment of the present invention.

FIG. 1 diagrammatically shows a steam ironing device 1 according to a first preferred embodiment of the present invention. The steam ironing device 1 comprises a steam iron 10 having a soleplate 11 and a housing 12 arranged on top of the soleplate 11. The housing 12 has a grip portion 13 for the purpose of enabling a user to handle the steam iron 10 in an easy manner during an ironing process.

Inside the housing 12 of the steam iron 10, a steam generator 20 for heating water to steam is arranged. The steam generator 20 is connected to a device 30 for supplying water, via a hose 40. The water supplying device 30 comprises a water tank 31 and a pump 32.

The steam ironing device 1 is adapted to generating a burst of steam on demand of a user. For the purpose of letting out such a burst of steam from the steam iron 10, a steam outlet 25 is arranged in the soleplate 11 of the steam iron 10. At a position between the steam outlet 25 and the steam generator 20, a controllable steam release valve 26 is arranged. In FIG. 1, a burst of steam is diagrammatically depicted as a collection of short lines, which is indicated by reference numeral 27.

The steam ironing device 1 comprises a controller 50 for controlling the operation of the steam generator 20, the operation of the pump 32, and a condition of the steam release valve 26, among other things. In FIG. 1, the controller 50 is diagrammatically depicted as a block, wherein controlling signals transmitted by the controller 50 to the steam generator 20, the pump 32 and the steam release valve 26 are represented by dashed lines. For sake of clarity, in FIG. 1, the controller 50 is depicted as being arranged separately, but in a practical embodiment of the steam ironing device 1, the controller 50 may be accommodated inside the housing 12 of the steam iron 10, for example.

During normal operation of the steam ironing device 1, the pump 32 is operated such as to supply water to the steam generator 20, and the steam generator 20 is operated such as to generate normal amounts of steam, which are let out of the steam iron 10 through outlet holes (not shown) arranged in the soleplate 11 of the steam iron 10. It is noted that during normal operation of the steam ironing device 1, the steam release valve 26 is in a closed condition.

During periods in which the generation of steam is not or less required in the ironing process, the pump 32 is still kept in operation, so that the water supply to the steam generator 20 is continued. Consequently, a reserve amount of steam is generated, which remains inside an internal space 21 of the steam generator 20, and which may fill at least a portion of the hose 40 as well. In the process, pressure is built up inside the steam generator 20 and the hose 40. In order to prevent the pressure from getting higher than a maximum allowable pressure, the controller 50 is adapted to stopping the operation of the pump 32 when a predetermined period of time has passed or when a predetermined pressure has been reached. In the latter case, the steam ironing device 1 may comprise a pressure sensor or the like for measuring the actual value of the pressure, and the controller 50 may be adapted to comparing the measured values of the pressure to a maximum allowable value.

When a user desires to have a burst of steam 27, the user communicates this desire to the controller 50 through suitable means for providing input to the controller 50, such as a button 51. In FIG. 1, input representing a user's need of a burst of steam 27 is diagrammatically depicted as a dashed arrow. As soon as the controller 50 receives such input, the steam release valve 26 is put to an opened condition, so that the amount of steam that is stored inside the internal space 21 of the steam generator 20 and, as the occasion arises, also in at least a portion of the hose 40, is released through the steam outlet 25, wherein a burst of steam 27 is realized. It is not necessary that all of the reserve amount of steam is used. Depending on the input of the user, a length of a period of time during which the burst of steam 27 takes place is variable. After the burst of steam 27 has taken place, the steam release valve 26 is put to the closed condition again.

An important advantage of the above-described way of realizing a burst of steam 27 is that it is possible to immediately generate the burst of steam 27, without any delay, as all that is needed for this purpose is putting the steam release valve 26 to the opened condition. As the burst of steam 27 is obtained on the basis of a sudden release of at least a portion of a reserve amount of steam, the generation of the burst of steam 27 is independent of the operation of the pump 32.

During the period in which the reserve amount of steam is built up, the steam ironing device 1 may be operated in a normal fashion, wherein normal amounts of steam are supplied to items which are subjected to a steam ironing process. These normal amounts of steam are let out through the outlet holes which are arranged in the soleplate 11 of the steam iron 10. Hence, it is possible to realize a cycle during the steam ironing process, in which periods of normal operation and normal steam release are alternated with bursts of steam.

In FIG. 2, the soleplate 11 of the steam iron 10, the steam generator 20, the steam release valve 26, the pump 32 and the water tank 31 of the steam ironing device 1 are diagrammatically shown. Furthermore, flows of water, air and steam are illustrated. In particular, a flow of water from the water tank 31 to the pump 32 is illustrated by an arrow extending from the water tank 31 to the pump 32, a flow of water from the pump 32 to the steam generator 20 is illustrated by an arrow extending from the pump 32 to the steam generator 20, a flow of steam from the steam generator 20 to the steam release valve 26 is illustrated by an arrow extending from the steam generator 20 to the steam release valve 26, and a flow of steam from the steam release valve 26 to the soleplate 11 of the steam iron 10 is illustrated by an arrow extending from the steam release valve 26 to the soleplate 11. The latter flow only takes place when the steam release valve 26 is put to the opened condition, and when a burst of steam 27 is realized.

FIG. 2 shows two components of the steam ironing device 1, which are not shown in FIG. 1, for sake of clarity. In the first place, FIG. 2 shows an air breather valve 22, which is provided for the purpose of letting in air into the steam generator 20 in order to prevent the development of a vacuum in the internal space 21 of the steam generator 20 when the steam generator 20 and an amount of steam that is present inside the steam generator 20 cool down. A flow of air is illustrated by an arrow extending from the soleplate 11 to the steam generator 20, through the air breather valve 22. In the second place, FIG. 2 shows an excess pressure relief valve 41, which is provided for the purpose of letting water leak back into the water tank 31 in order to prevent a pressure prevailing inside the steam generator 20 and the hose 40 from getting too high. A flow of water is illustrated by an arrow extending from a position between the pump 32 and the steam generator 20 to the water tank 31, through the excess pressure relief valve 41.

Within the scope of the present invention, other measures than providing the air breather valve 22 and the pressure relief valve 41 may be taken for the purpose of safeguarding a pressure prevailing inside the steam ironing device 1.

FIG. 3 diagrammatically shows a steam ironing device 2 according to a second preferred embodiment of the present invention. This steam ironing device 2 resembles the steam ironing device 1 according to the first preferred embodiment of the present invention to a large extent, with this difference that a steam reservoir 45 is provided, which serves for storing a portion of the reserve amount of steam that is generated by the steam generator 20 in a situation in which the steam release valve 26 is kept in a closed condition and there is hardly any need or no need at all of a supply of steam in the ironing process. In the shown example, the steam reservoir 45 is arranged on the hose 40. Condensation of steam inside the steam reservoir 45 is prevented on the basis of the fact that the steam reservoir 45 is heated under the influence of its direct connection to the steam generator 20. In principle, however, it is possible to add heating means (not shown) to the steam ironing device 2 for the purpose of heating the steam reservoir 45.

In comparison with the steam ironing device 1 according to the first preferred embodiment of the present invention, the capacity of storing a reserve amount of steam is enlarged. Therefore, it is possible to generate an even more powerful burst of steam 27, which may last for a longer period of time.

FIG. 4 diagrammatically shows a steam ironing device 3 according to a third preferred embodiment of the present invention. This steam ironing device 3 resembles the steam ironing device 1 according to the first preferred embodiment of the present invention to a large extent, with this difference that a pressurized water tank 33 is provided, which serves for storing water and keeping water in a pressurized condition. In the shown example, the pressurized water tank 33 is a spring-loaded water tank, but it is just as well possible that the pressurized water tank 33 is of another type.

The pressurized water tank 33 is connected to the hose 40 through a controllable electro-valve 34. In FIG. 4, a controlling signal transmitted by the controller 50 to the electro-valve 34 is represented by a dashed line. During normal operation of the steam ironing device 3, the electro-valve 34 is kept in a closed condition. However, when a burst of steam 27 is required, and the steam release valve 26 is put to the opened condition, the electro-valve 34 is put to an opened condition as well. As a result, the pressurized water gushes out of the pressurized water tank 33, flows into the hose 40 and reaches the steam generator 20, where the water is evaporated and transformed into steam. For the purpose of speeding up the process of evaporation, the flow of water may be conducted through a small orifice for atomizing the water.

In the steam ironing device 3 according to the third preferred embodiment of the present invention, a burst of steam 27 is not only obtained on the basis of a reserve amount of steam, but also on the basis of a swift supply of water to the steam generator 20, wherein the water is quickly transformed to steam that is released through the steam release valve 26 and the steam outlet 25. As a result, in comparison with the steam ironing device 1 according to the first preferred embodiment of the present invention, it is possible to generate an even more powerful burst of steam 27, which may last for a longer period of time. Like the steam ironing device 2 according to the second preferred embodiment of the present invention, the steam ironing device 3 according to the third preferred embodiment of the present invention may also comprise a steam reservoir 45 for storing a portion of the reserve amount of steam. In such a case, the capacity of the steam ironing device 3 for storing potential energy for creating a burst of steam 27 is even more enlarged.

It will be clear to a person skilled in the art that the scope of the present invention is not limited to the examples discussed in the foregoing, but that several amendments and modifications thereof are possible without deviating from the scope of the present invention as defined in the attached claims.

The measures according to the present invention for the purpose of obtaining a powerful burst of steam 27 may also be implemented in other steaming devices than the steam ironing devices as shown in the figures.

In the foregoing, a steam ironing device 1, 2, 3 is disclosed, which comprises a steam generator 20 for heating water to steam, a steam outlet 25 for letting out a burst of steam 27 from the steam generator 20, a device 30 for supplying water to the steam generator 20, and a controller 50 which is adapted to operating the water supplying device 30 during a period of time in a situation in which there is hardly any need or no need at all of a supply of steam in an ironing process, while keeping the steam outlet 25 closed. In this way, a reserve amount of steam is generated, which is stored in an internal space 21 of the steam generator 20, and, as the occasion arises, in at least one other space, for example space which is available in a hose 40 extending between the water supplying device 30 and the steam generator 20 and/or space which is available in a steam reservoir 45. When a user of the steam ironing device 1, 2, 3 desires to have a burst of steam 27, the reserve amount of steam is released through the steam outlet 25.

The invention claimed is:

1. Method for generating a burst of steam from a steam outlet of a steaming device having a steam generator for heating water to steam, the method comprising the following subsequent steps:

supplying water to the steam generator during a period of time while keeping the steam outlet closed, wherein steam is generated by the steam generator;

storing at least a portion of the steam inside the steaming device;

opening the steam outlet, whereupon the steam is released through the steam outlet as a burst of steam; and releasing a portion of the steam that is generated during the period of time in which the steam outlet is kept closed through outlet holes of the steaming device, which serve for letting out normal amounts of steam.

2. Method according to claim 1, further comprising feeding water in a pressurized condition from a pressurized water tank to the steam generator when the steam outlet is opened.

3. Method according to claim 1, wherein a length of the period during which water is supplied to the steam generator while the steam outlet is kept closed has a predetermined value.

4. Method according to claim 1, wherein a length of the period during which water is supplied to the steam generator while the steam outlet is kept closed is related to an actual value of a pressure prevailing inside the steaming device, wherein the supply of water is stopped as soon as this pressure has reached a predetermined value.

5. Method according to claim 1, wherein a device comprising a pump is used for the purpose of supplying water to the steam generator, and wherein the pump is operated during a period of time while the steam outlet is kept closed.

6. Steaming device, comprising:

a steam generator for heating water to steam;

a steam outlet for letting out a burst of steam from the steam generator;

a device for supplying water to the steam generator; and controlling means which are adapted to operating the water supplying device during a period of time while keeping the steam outlet closed, and to opening the steam outlet upon receipt of input representing a user's need of a burst of steam from the steam outlet, wherein a portion of the steam, generated during a period of time in which the steam outlet is kept closed, is released through outlet holes of the steaming device, which serve for letting out normal amounts of steam.

7. Steaming device according to claim 6, further comprising a steam reservoir or storing steam generated by the steam generator when the steam outlet is closed.

8. Steaming device according to claim 7, comprising a connection member connecting the water supplying device to the steam generator, wherein the steam reservoir is arranged on this connection member.

9. Steaming device according to claim 6, further comprising a pressurized water tank which is adapted to storing water and keeping water in a pressurized condition, and which is connected to the connection member, through a controllable water outlet member.

10. Steaming device according to claim 9, wherein the water outlet member comprises an electro-valve.

11. Steaming device according to claim 9, wherein the pressurized water tank is a spring-loaded water tank.

12. Steaming device according to claim 9, wherein the controlling means are adapted to putting the water outlet member to an opened condition upon receipt of input representing a user's need of a burst of steam from the steam outlet.

13. Steaming device according to claim 6, wherein the water supplying device comprises a pump, and wherein the controlling means are adapted to operating the pump during a period of time while keeping the steam outlet closed.

14. Steaming device according to claim 6, wherein the steaming device is a steam ironing device.

15. Steaming device according to claim 9, wherein the controllable water outlet member is a valve.

* * * * *